United States Patent [19]

Robbins

[11] 3,982,289

[45] Sept. 28, 1976

[54] DISPOSABLE SINK STRAINER

[76] Inventor: David Robbins, 123 W. 75th St., New York, N.Y. 10023

[22] Filed: Apr. 10, 1975

[21] Appl. No.: 567,039

[52] U.S. Cl. ..... 4/292

[51] Int. Cl.[2] ..... E03C 1/26

[58] Field of Search ..... 4/286, 287, 290, 289, 4/292

[56] References Cited

UNITED STATES PATENTS

| | | | |
|---|---|---|---|
| 2,025,281 | 12/1935 | Harvey | 4/290 |
| 2,033,285 | 3/1936 | Harvey | 4/290 |
| 2,077,516 | 4/1937 | Dant | 4/286 |
| 2,512,867 | 6/1950 | Marcussen | 4/287 |
| 2,569,615 | 10/1951 | Link | 4/287 |
| 3,007,179 | 11/1961 | Bertulli | 4/287 |
| 3,596,294 | 8/1971 | Hoffman | 4/287 |
| 3,800,339 | 4/1974 | Bergin | 4/286 X |

*Primary Examiner*—Henry K. Artis
*Attorney, Agent, or Firm*—Allison C. Collard

[57] ABSTRACT

A disposable sink strainer comprising a cylindrical portion having a plurality of openings therein and a bottom portion substantially constituting a disc and integrally connected to and depending from a lowermost portion of the cylindrical portion, the bottom portion being formed with a plurality of holes therein. The cylindrical walls are adapted to fit complementarily in a conventional sink strainer, and have a rim extending horizontally and radially outwardly and integrally therefrom at an uppermost portion thereof.

6 Claims, 3 Drawing Figures

DISPOSABLE SINK STRAINER

The present invention relates to a disposable sink basket.

When washing dishes in a household sink, food particles fall into a sink strainer basket which is conventionally provided in a drain type sink. As a result, the person who washes the dishes and cleans the sink must scrape the waste food particles out of the sink strainer basket. This is an unpleasant task.

Accordingly, it is one object of the present invention to remedy the above-mentioned situation, in connection with the cleaning and washing of the dishes and sink.

It is another object of the present invention to provide a disposable sink basket which is releasably mounted on top of a conventional sink basket and which solves the above-mentioned problems.

It is still a further object of the present invention to provide a disposable sink basket which is of a size perfectly fitting the drain and/or conventional sink basket, and is provided with a plurality of openings in both a bottom portion and a cylindrical surface thereof, and including tabs projecting into the sink basin for ready removal of the basket from the sink, and for disposal.

A disposable sink basket, in accordance with the present invention is preferably made of plastic, constituting a plastic cup able to be economically produced by injection-molding processes in mass production, and is of interest to anyone who washes dishes, particularly since garbage disposal systems are gradually being phased out, because of plumbing difficulties. The disposable sink basket in accordance with the present invention is an economical and ecological alternative.

A disposable sink basket in accordance with the present invention is similar in respect to the conventional sink basket strainer, except in accordance with the present invention, it is made of plastic and has a combination of three special features.

Firstly, the sink basket in accordance with the present invention is provided with a pushout center, and/or two criss-cross incisions in the bottom, to allow the user to place same over the conventional sink basket. If one desires to close the drain, the stopper is simply pushed down or it may be left intact to let the water run freely.

Secondly, the disposable sink basket in accordance with the present invention is provided with two tabs on opposite ends of the basket to allow the user a greater facility in the transition from sink to trash receptacle.

Thirdly, the disposable sink basket in accordance with the present invention is provided with an outer rim that extends sufficiently far out to fit any drain.

In accordance with the present invention there is provided a disposable sink strainer comprising a cylindrical portion having a plurality of openings therein and a bottom portion substantially constituting a disc and integrally connected to and depending from a lowermost portion of the cylindrical portion, the bottom portion being formed with a plurality of holes therein. The cylindrical walls are adapted to fit complementarily in a conventional sink strainer, and have a rim extending horizontally and radially outwardly and integrally therefrom at an uppermost portion thereof.

Other objects and features of the present invention will become apparent from the following detailed description taken in connection with the accompanying drawings, which disclose a further embodiment of the invention. It is to be understood, however, that the drawing is designed for purposes of illustration only and not as a definition of the limits and scope of the invention.

In the drawings, wherein similar reference numerals denote similar elements throughout the several views.

Figure 1:
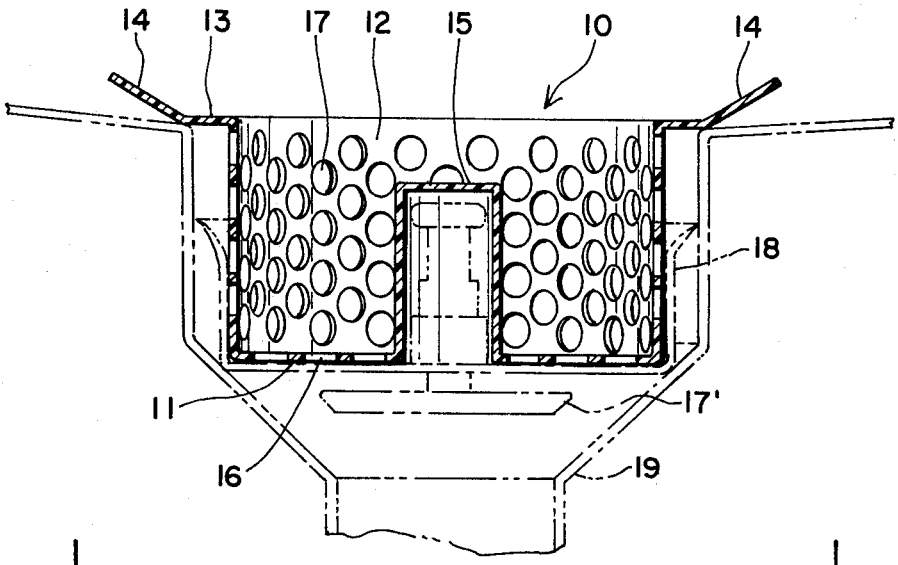
FIG. 1 is a longitudinal cross-sectional view of a disposable sink basket in accordance with a first embodiment of the present invention shown mounted in a conventional drain.

Referring now to the drawing, a disposable sink basket 10 in accordance with the present invention, preferably constructed of a plastic material capable of withstanding hot water temperatures, is adapted in shape to fit within a conventional sink strainer 18, shown in dot dashed lines, in order to catch food materials for disposal.

The disposable sink basket 10 in accordance with the present invention is preferably provided with cylindrical sides 12*a* adapted to fit complementarily in the basket portion of the conventional strainer 18 in the sink, extending upwardly therefrom, and has a bottom disc portion 11 provided with a plurality of holes 16. The cylindrical portion 12 is likewise provided with a plurality of circular holes 17, the holes forming a plurality of vertical columns offset with respect to adjacent columns as shown in FIG. 1. The upper end of the cylindrical basket is provided with a radially outwardly depending rim 13, and the height of the basket and the beginning of the rim 13 are at the level of the base of the sink adjacent the drain. The rim 13 is adapted to snugly engage the sides of the base of the sink.

The disposable strainer includes a pair of tabs 14 extending upwardly at an acute angle relative to the base of the sink and to the rim 13, in order to facilitate the easy removal of the disposable strainer with the entrapment of food particles which are caught in the hollow of the strainer during the washing of dishes.

As illustrated in FIG. 1, the strainer in accordance with the present invention further includes a projecting hollow central projection 15 having a hollow central core thereunder and complementarily adapted to engage on a central extension knob of the conventional sink basket 17′ 18 which knob is used to lock the strainer in place and to seal the drain opening. In this manner, the strainer in accordance with the present invention completely covers the knob as well as the metal strainer therebelow.

No holes are provided in the central extension 15, which extends upwardly merely sufficiently to cover the top of the knob. In accordance with the present invention, the disposable sink strainer fits completely over the permanent metal conventional sink strainer.

Figure 2:
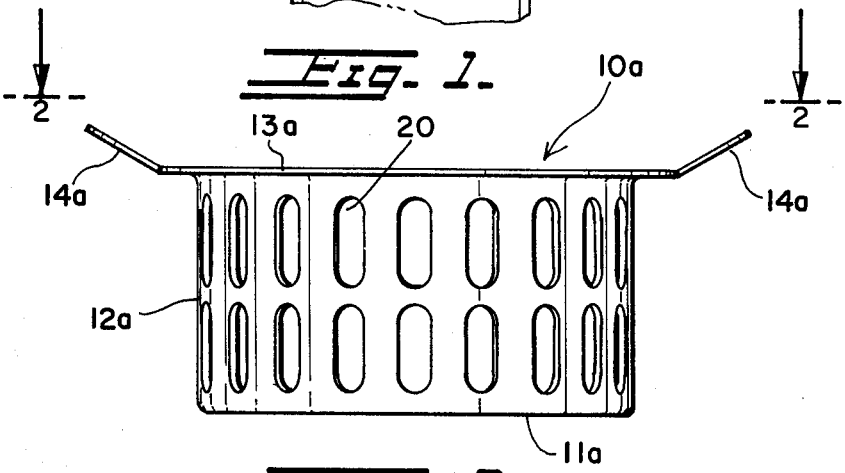
FIG. 2 is a side elevation of a second embodiment of a disposable drain in accordance with the invention.
Figure 3:
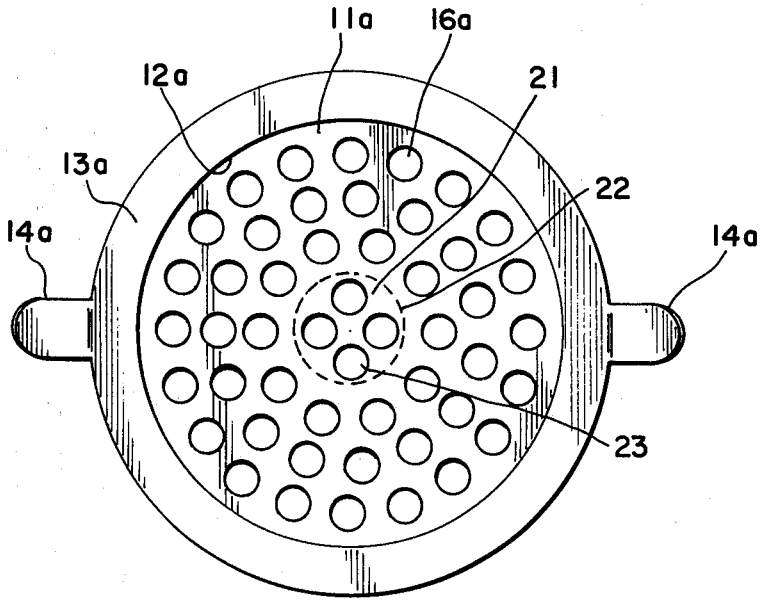
FIG. 3 is a top plan view of the disposable drain of FIG. 1 viewed along the lines 2—2 of FIG. 2.

Referring now to the drawings, more particularly to FIGS. 2 and 3, a second embodiment of a disposable sink strainer 10*a* of the present invention is shown having a cylindrical portion 12*a* adapted to fit into a conventional sink basket. In the cylindrical portion 12*a*, a plurality of holes 20 are provided which holes are preferably elongated, each being approximately three times the length of the diameter of the circular end portions thereof. The holes 20 are aligned in two circumferential and aligned rows.

In the embodiment of FIGS. 2 and 3, no hollow extension portion 15 is provided, as in FIG. 1.

However, the center portion 21 of the bottom 11*a* of the disposable strainer, is formed as a perforated push out section indicated by the dash-dotted lines 22; as an alternative, criss-crossing incisions (not shown) may be provided, in both of which cases, an opening is provided whereby the knob of a conventional strainer can be insertingly pushed into the opening to hold the disposable strainer 10*a* in position.

In accordance with the present invention, tabs 14*a* are provided extending from an annular horizontal rim 13*a* as in the first embodiment. In both embodiments, the taps are very small and substantially no food will get caught therein. The tabs have parallel edges and a width substantially equal to the annular thickness of the rim.

The perforated portion 22 of the bottom 11*a* as shown in FIGS. 2 and 3 covers a radial distance of approximately one-fourth of the radius of the cylindrical walls 12*a*.

While two embodiments of the present invention have been shown and described, it will be obvious that many changes and modifications may be made thereunto without departing from the spirit and scope of the invention.

What is claimed is:

1. A disposable sink strainer adapted to be mounted on top of a conventional sink basket in a sink and removed therefrom, comprising:

a cylindrical portion having a plurality of openings therein forming a plurality of vertical columns;

a bottom portion substantially constituting a disc and integrally connected and depending from a lowermost portion of said cylindrical portion, said bottom portion being formed with a plurality of holes therein;

said cylindrical walls being of a size adapted to fit complementarily in said conventional sink strainer;

a rim extending horizontally and radially outwardly and integrally from an uppermost portion of said cylindrical portion and adapted to snugly engage the sides of the base of said sink; and means integrally connected with said rim to remove said disposable sink strainer from said conventional sink strainer and sink.

2. The disposable sink strainer, as recited in claim 1 wherein:

said rim is aligned substantially with a base of a sink adjacent to the drain; and said integrally connected means including two tabs aligned 180° apart from each other and extending from an outer peripheral edge of said rim and inclined upwardly relative thereto forming an acute angle with said base of the sink.

3. The disposable sink strainer, as recited in claim 2 wherein:

said tabs each have parallel edges and a circular rounded portion at a free end thereof, the distance between said edges, constituting the width of said tabs, being substantially equal to the annular width of said rim.

4. The disposable sink strainer as recited in claim 3 wherein:

said openings are circular and form said columns offset adjacent one another.

5. The disposable sink strainer, as recited in claim 1 wherein:

said openings are elongated and are aligned forming said vertical columns and two circumferential rows.

6. The disposable sink strainer as recited in claim 1, further comprising:

a central cylindrical extension internally formed upwardly from said bottom portion and defining a hollow complementarily engaging on a knob of a conventional sink basket.

* * * * *